United States Patent [19]

Gradeff

[11] Patent Number: 4,973,501

[45] **Date of Patent: * Nov. 27, 1990**

[54] LANTHANIDE IMPREGNATED WOOD COMPOSITION AND METHOD FOR PERMANENTLY DEPOSITING WATER INSOLUBLE LANTHANIDE DERIVATIVES INTO WOOD MATERIALS

[75] Inventor: Peter S. Gradeff, Pottersville, N.J.

[73] Assignee: Rhone-Poulenc Inc., Princeton, N.J.

[ * ] Notice: The portion of the term of this patent subsequent to May 10, 2005 has been disclaimed.

[21] Appl. No.: 349,442

[22] Filed: May 9, 1989

[51] Int. Cl.[5] ..... B05D 1/18

[52] U.S. Cl. ..... 427/440; 106/15.05; 106/286.1; 428/541; 428/702

[58] Field of Search ..... 427/287, 440; 428/541, 428/702; 106/15.05, 286.1; 252/397

[56] References Cited

U.S. PATENT DOCUMENTS

| | | | |
|---|---|---|---|
| 2,565,175 | 8/1951 | Hager | 167/38.5 |
| 3,519,476 | 7/1970 | Bremmer et al. | 117/136 |
| 3,740,264 | 6/1973 | Lynch et al. | 117/136 |
| 3,945,835 | 3/1976 | Clarke et al. | 106/15 R |
| 4,038,086 | 7/1977 | Clarke et al. | 106/15 R |
| 4,090,000 | 5/1978 | Hatcher | 427/393 |
| 4,303,705 | 12/1981 | Kelso, Jr. | 427/351 |
| 4,380,561 | 4/1983 | Sundman et al. | 427/421 |
| 4,382,105 | 5/1983 | Amundsen et al. | 427/370 |
| 4,399,195 | 8/1983 | Allen, Sr. | 428/541 |
| 4,420,542 | 12/1983 | Sowers | 428/541 |
| 4,622,248 | 11/1986 | Leach et al. | 427/440 |
| 4,649,065 | 3/1987 | Hein et al. | 427/370 |
| 4,731,265 | 3/1988 | Hirao et al. | 427/440 |
| 4,743,473 | 5/1988 | Gradeff et al. | 427/297 |
| 4,752,509 | 6/1988 | Simonson et al. | 427/440 |
| 4,759,872 | 7/1988 | Marx et al. | 252/400 |
| 4,767,458 | 8/1988 | Moewius et al. | 106/18.31 |
| 4,842,898 | 6/1989 | Gradoff | 427/440 X |

*Primary Examiner*—Michael Lusignan

*Attorney, Agent, or Firm*—Morgan & Finnegan

[57] ABSTRACT

Described is a wood composition and a method for its preparation by treating wood with a first aqueous solution comprising one or more lanthanide derivatives, optionally rinsing with water and finally treating the wood with a second aqueous solution comprising one or more bases or one or more acid salts thereby precipitating a water-insoluble lanthanide complex within the wood. In addition, the method may be practiced by reversing the order of the treatment steps.

26 Claims, No Drawings

LANTHANIDE IMPREGNATED WOOD COMPOSITION AND METHOD FOR PERMANENTLY DEPOSITING WATER INSOLUBLE LANTHANIDE DERIVATIVES INTO WOOD MATERIALS

FIELD OF THE INVENTION

The invention relates to a wood composition and method of permanently depositing water insoluble lanthanide derivatives into wood materials.

BACKGROUND OF THE INVENTION

Wood preservatives known in the art are either oil-based or water-based. Oil-based preservatives fall into two main classes, namely (i) coal tar creosote and solutions of creosote with coal tar or petroleum oils and (ii) solutions of Preservative chemicals, such as pentachlorophenol dissolved in a suitable organic carrier.

One disadvantage of oil based preservatives is that they exude from the wood. Thereafter they may wash from the surface or evaporate. In order to compensate for the loss of the oil-based preservative, high initial retentions are required. In tropical and high rainfall areas, the use of oil-based preservatives has been found to be uneconomical. Another disadvantage of certain oil-based preservatives is that they are regarded as skin irritants and can cause burns. Furthermore, oil-based preservatives such as creosote cannot be painted and do not have attractive appearances. These preservatives often have toxic side effects.

Water based preservatives are those containing chemical preservatives in the form of aqueous solutions. Such preservatives react within the wood to form compounds, the solubility of which may be increased by adjustment of pH. When chemical changes occur within the wood resulting in compounds with very low solubility, the compounds are designated as leach-resistant. Those which form soluble compounds are designated as leachable.

Leach-resistant water-based preservatives in commercial use include acid copper chromate solution (ACC), chromated copper arsenate solution (CCA) and ammoniacal copper arsenate solution (ACA). CCA solutions are commonly used. They form, in the wood, compounds which are toxic to both fungi and insects. Leachable water-based preservatives include chromated zinc chloride and fluoride-chromium-arsenate-phenol mixtures and boron compounds. The leachable water-based preservatives can only be used in treating timber to be used internally or where leaching conditions are not severe.

Use of water-based preservatives has many advantages: cleanliness, paintability of the treated wood, freedom from odor, and when correctly applied, longer protection of the wood.

The American Wood-Preserver's Association "Book of Standards" (1986) defines and describes on pages 1978 and 1979 well known techniques for applying wood preservative compositions. Among these are mentioned:

Brushing
Butting
Diffusion
Dipping
Double Pressure
Dual
Empty-Cell
End Pressure
Full-Cell
Internal
Non-Pressure
Pressure
Spray
Surface
Thermal
Vacuum These methods achieve the desired result of applying compositions having wood preservation properties to wood. The descriptions of wood preservation methods described on these pages and throughout the Book of Standards are hereby incorporated by reference.

Essential features of the pressure method are that (1) the wood is surrounded by a preservative solution in a closed vessel; and (2) hydrostatic pressure is applied by mechanical means to force the solution into the wood fibers by replacing air or water already there, or going into any voids. It is conventional to evacuate the system to about 26 inches of mercury vacuum to remove air from cells within the wood. When a solution of CCA is used to impregnate wood, the CCA reacts inside the wood with reducing sugars found therein to form a mixture of insoluble salts.

U.S. Pat. No. 2,565,175 to Häger describes a method of preserving wood using specific types of preservatives in combination with specific methods and conditions of penetration and distribution of these preservatives within the wood. One specific type of preservative is CCA, to which ammonia is added to render the preservative solution alkaline. The ammonia addition prevents rapid fixation of the preservative in the wood. According to the method described by Häger, the preservative is introduced into the wood and the wood is kept in an undried condition for a period of time during which no fixation of the preservative occurs, and the preservative diffuses through the cell walls. Thereafter, the wood is dried.

U.S. Pat. No. 4,303,705 to Kelso, Jr. describes a Process for preserving wood against attack by living organisms, e.g., fungi and insects. The process may comprise one or two steps. In the two step process, there is a fungicidal step comprising introducing a copper solution into wood, and an insecticidal step comprising introducing a chromium and arsenic solution into wood.

One disadvantage of using CCA is that not all fixation of the preservative takes place in the wood. Sludging may occur in the working solution due to pickup of wood or wood extractives, corrosion, or impurities in the chemicals used to make up the solution. Sludging causes a deposit of solids on the surface of the wood. These deposits contain varying percentages of arsenic and thus are a matter of environmental concern. Recent treatment standards (AWPA 1982) have recognized this (see Hartford, W., "The Practical Chemistry of CCA in Service" , American Wood Preservers. Association Annual Meeting, Apr. 28, 29 and 30, 1986, pp. 1–16).

Lanthanide derivatives are used in glass, ceramic, paint, plastics, and rubber manufacture. Compositions comprising cerium compounds are known to have bactericidal effects, e.g. compositions comprising cerium nitrate and silver sulfadiazine (Boeck, et al., *Burns* vol. 11, no. 5 (1985) pp. 337–342; Monafo, *3rd International Congress on Pharmacological Treatment of Burns,* Milan, Italy, May 12–15, 1980, *Panmainerva Med.*, vol. 25, no.

3 (1983) pp. 151–154; Bowser, et al., *J. Trauma,* vol. 21, no. 7 (1981) pp. 558–563; Monafo, et al., *Arch Surg.* vol. 113, no. 4 (1978) pp. 397–401; Monafo, et al. *Surgery* (St. Louis) vol. 80, no. 4 (1976) pp. 465–473), and compositions containing electrically activated silver and cerium stearate (Colmano, et al., 23*rd Annual Meeting of the Biophysical Society* (*New York*), Atlanta, Ga., Feb. 26–28, 1979, *Biophys. J.* vol. 25, no. 2, part 2 (1979) P.217A). Cerium derivatives are also used as additives in plastics for food packaging.

U.S. Pat. No. 4,743,473 to Gradeff et al. incorporated herein by reference describes a method of preserving wood with lanthanide derivatives. The method involves the pressure treatment of wood using compositions comprising aqueous solutions of one or more lanthanide derivatives. It is believed that this treatment process produces wood containing leach-resistant lanthanide ions cross-linked with cellulose fibers in the wood. However, if U the wood is contacted with water for extended periods of time, it is possible that the lanthanide ions may eventually leach out.

U.S. Ser. No. 07/267,009 incorporated herein by reference (filed Nov. 4, 1988) now U.S. Pat. No. 4,883,689 to Gradeff also describes a method for preserving wood with lanthanide derivatives. In this process, wood is treated with organic solutions of one or more lanthanide derivatives. It is believed that this treatment process produces wood containing leach-resistant lanthanide complexes. Such complexes should be leach-resistant even when contacted with water for extended periods of time since the organo-soluble complexes deposited in the wood are water-insoluble. However, a potential drawback in this procedure is the use of organic solvents in the treatment process. Use and disposal of such chemicals may be undesirable on health and environmental grounds.

U.S. Pat. No. 4,090,000 to Hatcher discloses a two-step process to treat wood by first impregnating the wood with an aqueous solution of a polychlorophenate salt followed by the injection of an acid into the impregnated wood to precipitate the polychlorophenol in situ. However, Hatcher effectively teaches away from this process by noting that such a process requires a drying step, may require more elaborate facilities and most importantly, may prevent full permeation of the wood to be treated by formation of an outer perimeter plug of precipitated solid.

It is an object of the present invention to provide a new safe two-step method for treating wood or wood derived matrices with compositions comprising water-soluble lanthanide derivatives and then rendering said lanthanide derivatives leach-resistant by treatment of the wood with a second reactant solution comprising a base or a salt of an acid whereby water-insoluble lanthanide derivatives are produced within the wood. It is also an object of this invention to provide a means for impregnating wood with water-insoluble lanthanide derivatives without the use of potentially harmful organic solvents.

It is a further object of the invention to provide a variant of the aforementioned treatment process by reversing the order of treatment.

It is a further object of the present invention to promote flame retardation and to inhibit wood deterioration organisms such as exposure to wood-destroying organisms such as bacteria, insects and fungi to atmospheric conditions such as exposure to sunlight.

These and other objects are met by the present invention and are further described in the specification.

SUMMARY OF THE INVENTION

The invention is directed to a method for treatment of wood comprising the following steps:

(1) impregnation of the wood with compositions comprising aqueous solutions of one or more lanthanide derivatives, followed by (2) impregnation of the wood with compositions comprising aqueous solutions of one or more bases or one or more salts of acids to form a water insoluble precipitate within the wood. The method of this invention may also be practiced by reversing the order of the steps.

Impregnation of the wood with aqueous solutions as disclosed above is accomplished by one or a combination of the several known techniques chosen to accomplish the desired degree of penetration for the purpose of the intended use. This might include pressure treatment, vacuum treatment, surface treatment that includes dipping and spraying, brushing, full cell treatment and other modes of treatment as known in the art.

The invention is also directed to a composition comprising wood and lanthanides or lanthanide derivatives prepared by the above method. This composition is resistant to deterioration that occurs to lanthanide-free wood exposed to wood destroying organisms such as bacteria, insects and fungi, as well as environmental conditions that promote decay.

DETAILED DESCRIPTION OF THE INVENTION

According to the methods of this invention wood is treated by (1) impregnation with an aqueous solution containing one or more lanthanide derivatives, followed by (2) impregnation with an aqueous solution containing one or more bases or impregnation with an aqueous solution containing one or more salts of acids. The method of this invention may also be practiced by reversing the order of treatment steps one and two. Additionally, either method may be practiced by rinsing the wood with water between the contacting steps. Preservation treatment of wood is applied to a variety of forms or types of wood: Lumber, timber, bridge and wire ties, fence posts, plywood, floor blocks and platforms, wood for commercial residential construction, marine construction, structural lumber, laminated material fibers and pulp, cooling towers, wood used for harvesting storage, and transportation of food stuffs. The term wood as used herein, comprises but is not limited to all these. The term wood also comprises the above forms or types of wood-derived matrices. Wood derived matrices are disclosed by Gradeff in U.S. Ser. No. 07/259,284 now U.S. Pat. No. 4,881,976 which i incorporated herein by reference. Wood derived matrices would be substances chemically derived from wood such as wood pulp, refined wood pulp, lignin derivatives, wood rosin, rosin cellulose, modified rosin, rosin gum salts, rosin derivaties or combinations thereof.

Suitable lanthanide derivatives include the lanthanide elements such as lanthanum, cerium, praseodymium, neodymium, samarium, europium, gadolinium, terbium, dysprosium, holmium, erbium, thulium, ytterbium and lutetium. Cerium is preferable and can be trivalent or tetravalent.

The lanthanide cation can be bonded to an inorganic anion such as nitrate, chloride, sulfate, perchlorate, Phosphate, or phosphonate. Lanthanide chlorides and nitrates are preferrable. The lanthanide cation can also be bonded to an organic ligand such as lower alkyl carboxylate, e.g. acetate, propionate, acrylate, methacrylate, gluconate, lactate, alkyl sulfonate or alkyl phosphonate. Derivatives having both inorganic and organic ligands are also suitable in the present invention.

The lanthanide derivatives may be used alone or in admixture with other wood treatment agents such as flame retardants, coloring agents, anti-checking agents, anti-static agents, dimensional stabilizers, film-forms, wood softening agents, and other biocides or fungicides.

The lanthanide derivatives must be soluble in water, preferably in a concentration at least about 0.1% by weight. Use of concentrations less than 0.1% by weight is not economical. Concentrations about 0.1% to about 10% are preferred, although higher concentrations can be used. Concentrations about 0.5% to about 2.5% are more preferred.

The bases suitable for practice of the method of this invention are any water-soluble bases which react with water-soluble lanthanide complexes to produce water-insoluble lanthanide derivatives. Such bases are preferably weak bases such as sodium carbonate and ammonia which should not effect the wood. However, stronger bases such as alkali metal and alkaline earth hydroxides in dilute aqueous solution can also be used.

A suitable salt of an acid for practice of the method of this invention is any water-soluble salt which reacts with water-soluble lanthanide complexes to produce water-insoluble lanthanide derivatives. Non-limiting examples of such salts are sodium dodecyl benzene sulfonate, sodium or potassium stearate, sodium or ammonium acetylacetonate, sodium octoate, sodium naphthenate (or other high molecular weight carboxylates) and soluble alkali phosphates or phosphonates.

The wood treated by the method of this invention contains lanthanide complexes which are leach-resistant. The complexes are believed to be leach-resistant for a number of possible reasons including but not limited to the cross linking of cellulose fibers in the wood with the lanthanide ion and the water-insolubility of the lanthanide complex derived from the reaction of the water-soluble lanthanide complexes with the aqueous solution of the base or salt of an acid. Non-limiting examples of water-insoluble lanthanide derivatives are lanthanide hydroxides/lanthanide oxides, lanthanide stearates, lanthanide octoates, lanthanide naphthenates, lanthanide phosphates, lanthanide phosphonates and lanthanide dodecylbenzene sulfonates. The water-insoluble cerium derivatives are preferred.

The mechanism of preservation of wood treated with lanthanides is not well understood. It appears to differ from what is believed to be the mechanism of action of any of the currently used preservatives as lanthanides are not generally considered being toxicants.

The time necessary to achieve a sufficient amount of impregnation of the wood with the aqueous solutions depends on several factors, e.g. type of treatment and type of wood material to treat as well as the condition of the material prior to the treatment. Any suitable method to apply aqueous solutions to the wood material can be used. Several methods are practiced and recognized by the American Wood Preservative Association. They are defined below:

Brush: Application of one or more coats of liquids preservative to the surface of timber with a brush.

Butt: Preservative treatment applied to the lower, or butt end of posts and poles; usually by the Thermal Process.

Pressure: The impregnation of wood with a liquid by application of pressure above atmospheric or above any initial air pressure which may have been applied.

Diffusion: A treatment in which green wood or water-soaked wood is immersed in an aqueous solution or has applied to it a paste or solid containing water-soluble chemicals, to permit the chemicals to diffuse into the water in the wood.

Dip: Application of a liquid preservative to a wood by immersing the wood in the liquid for a short period of time.

Dual: Treatment of wood to be used under severe conditions of exposure with two dissimilar synergistic preservatives in two separate treating cycles, e.g. treatment o marine piles and timbers for areas of extreme borer hazard. Usually, the first treatment is with a water-borne salt preservative; and the second with creosote or creosote-coal tar solution.

Empty-Cell: A treatment in which air imprisoned in the wood is employed to force out part of the preservative when treating pressure is released and a final vacuum is applied.

Internal: A treatment applied by injecting into a pole or timber, through holes bored for the purpose, sufficient preservative material to protect against deterioration from wood-destroying organisms.

Non-Pressure: A process for treating wood which does not require the use of hydraulic pressure.

Spray: Application of one or more coats of a liquid preservative to the surface of wood with a spraying device.

Surface: Superficial application of a liquid preservative to wood by brushing, spraying, or dipping.

Thermal: A process of impregnating wood by (a) submerging it in hot preservative or fluid for various lengths of time, and then (b) in preservative at a lower temperature, with resulting reduction of pressure within the wood and forcing of the preservative into the wood by atmospheric pressure.

Vacuum: Application of treating liquids to wood in a closed vessel by evacuating or partially removing the air from the vessel and introducing the liquid without re-admitting air.

Full-Cell: A treatment involving a preliminary vacuum followed by pressure impregnation such that the cell cavities in the treated portion of the wood remain partially or completely filled with preservative.

Within the scope of the in are methods of conditioning of the wood which involve preliminary steps aimed to enhance penetration of the aqueous solutions into the wood. These steps include: air-seasoning, kiln drying, vacuum drying, steaming or a combination of these.

Methods of treatment such as *Surface Treatment* for instance by dipping, spraying or brushing are self explanatory. The treatment can be single or repeated, in combination with other agents or in alternate fashion involving different concentrations of treating solutions, all depending on the extent of the penetration desired. Treatment can be done at about room temperature or higher.

*Vacuum application* can be seen as two step treatment. First, subjecting the wood under vacuum, then introducing the treating solution without re-admitting air. It is obvious that the parameters of this method can be varied to a considerable extent. Seasoned, or pre-conditioned wood will require less time and vacuum than wet wood. The time as well as the vacuum, will depend on the size or shape of the material to be treated and the depth of penetration desired. The same goes for the temperature. The purpose of the vacuum step is to empty wood cells from humidity and air so that the treating solution could burst into the empty cell under lesser resistance. The effect is similar to the one of treating the wood under pressure, and so are the results. Although pressure treatment is more common than vacuum treatment, the American Wood Preservation Association has adopted the vacuum method as a standard method for applying wood preservatives.

*Pressure Treatment* can be used to treat previously conditioned wood or if suitable to treat the wood or wood fiber as is. It consists of applying hydrostatic pressure to wood material submerged into the treating solution. The time can vary widely depending on the condition of the wood, the type as well as its thickness. Normally from about 0.5 to about 10 hours are sufficient. Of course longer periods may be used. Contact time may be decreased with increased pressure. Preferred contact time is from about 3 to about 6 hours.

Preferably, pressure is between about 10 psi and about 300 psi, more preferably about 50 psi to about 280 psi. The pressure can be maintained using one or more inert gases, e.g. nitrogen gas, or by applying the composition under pressure generated by a pump.

Treatment temperature should not exceed about 95° C. Preferably, temperatures are about ambient, i.e. 20°-30° C. For some treatments, temperature of about 40°-60° C. is preferred to assist penetration of the aqueous solutions to the wood fibers. After treatment, the first aqueous treating solution is drained. The solution may be reserved and the amount of reactant calculated and replenished so that the solution can be used to treat another load of wood. The wood may then be sprayed or washed briefly with pure water to prevent loss of the second reactant by premature reaction with lanthanide complex, base or salt of an acid which may remain from the first solution treatment. The second treatment solution is then introduced and the wood impregnated with this solution by any of the treatment methods described above.

The treated wood is simply left to air dry. The treated wood is resistant to decay caused by exposure to bacteria, insects or fungi and atmospheric conditions. Furthermore, the treatment promotes flame retardation. One of the great advantages of using lanthanides is their relative safety which is important during processing, disposing or subsequent leaching or sludging as they normally occur.

EXAMPLE 1

Wood blocks are conditioned, weighed and soaked with a 1% aqueous cerium nitrate solution for 24 hours at room temperature, leached immediately without aging and analyzed for ashes. The amount of ash obtained indicated 0.1-0.3% retention.

A pair of blocks treated with cerium nitrate as above were immersed in 1% ammonia solution for 12 hours at room temperature and atmospheric pressure, leached for 48 hours and then aged. The amount of ashes obtained averaged 1.1.

EXAMPLE 2

A pair of blocks were kept under vacuum for 2 hours, then drowned with a 1% aqueous solution of sodium dodecylbenzene sulfonate. After a few hours, they were left to dry at room temperature and treated similarly with a 1% aqueous cerium nitrate solution. They were then leached for 2 days under running water and then ashed. The average amount of ashes was 0.83%.

While specific embodiments of the present invention have been shown and described, it should be apparent that many modifications can be made thereto without departing from the spirit and scope of the invention. Accordingly, the present invention is not limited by the foregoing description, but is only defined by the scope of the claims appended hereto.

What is claimed is:

1. A method of preserving wood or wood-derived matrices comprising the steps of:

(a) contacting the wood or wood-derived matrices with a first aqueous solution comprising a lanthanide derivative to impregnate the wood or wood-derived matrices with the lanthanide derivative; and (b) contacting the wood or wood-derived matrices with a composition comprising a second aqueous solution comprising a compound reactive with the lanthanide derivative or derivatives of step (a) to impregnate the wood or wood-derived matrices with the reactive compound and produce a water-insoluble lanthanide complex impregnated in the wood or wood-derived matrices.

2. The method according to claim 1, wherein the lanthanide is cerium.

3. The method according to claim 2, wherein the reactive compound comprises one or more bases.

4. The method according to claim 2, wherein the reactive compound comprises one or more salts of an acid.

5. The method according to claim 1, further comprising rinsing the lanthanide derivative impregnated wood or wood-derived matrices with water between the contacting steps.

6. The method according to claim 5, wherein the lanthanide is cerium.

7. The method according to claim 5, wherein the lanthanide derivative is selected from the group consisting of cerium nitrate and cerium chloride.

8. The method according to claim 6, wherein the reactive compound comprises one or more bases.

9. The method according to claim 6, wherein the reactive compound comprises one more salts of acids.

10. The method according to claim 6, wherein the reactive compound is selected from the group consisting of ammonia, alkali metal bases and alkaline earth bases.

11. The method according to claim 6, wherein the reactive compound is selected from the group consisting of sodium and potassium dodecylbenzene sulfonate, salts of phosphates, salts of phosphonates, and sodium and potassium salts of high alkyl carboxylic acids.

12. A method of preserving wood or wood-derived matrices comprising the steps of:

(a) contacting the wood or wood-derived matrices with a first aqueous solution comprising a compound reactive with a water-soluble lanthanide derivative to impregnate the wood or wood-derived matrices with the reactive compound; and (b) contacting the wood or wood-derived matrices with a second aqueous solution comprising the lanthanide derivative reactive with the compound of step (a) to impregnate the wood or wood-derived matrices with the lanthanide derivative and produce a water-insoluble lanthanide complex or complexes impregnated in the wood or wood-derived matrices.

13. The method according to claim 12, wherein the lanthanide is cerium.

14. The method according to claim 13, wherein the reactive compound comprises one or more bases.

15. The method according to claim 13, wherein the reactive compound comprises one or more salts of acids.

16. The method according to claim 12, further comprising rinsing the wood or wood-derived matrices with water between the contacting steps.

17. The method according to claim 16, wherein the lanthanide is cerium.

18. The method according to claim 16, wherein the lanthanide derivative is selected from the group consisting of cerium nitrate and cerium chloride.

19. The method according to claim 17, wherein the reactive compound comprises one or more bases.

20. The method according to claim 17, wherein the reactive compound comprises one or more salts of acids.

21. The method according to claim 17, wherein the reactive compound is selected from the group consisting of ammonia, alkali metal bases and alkaline earth bases.

22. The method according to claim 17, wherein the reactive compound is selected from the group consisting of sodium and potassium dodecylbenzene sulfonate, salts of phosphates, salts of phosphonates, and sodium and potassium salts of high alkyl carboxylic acids.

23. A lanthanide-impregnated wood composition comprising wood, or a wood derived matrix, and a water insoluble lanthanide derivative, in the absence of an organic solvent.

24. The composition of claim 23, wherein the lanthanide is cerium.

25. A lanthanide-impregnated wood composition consisting essentially of wood, or a wood-derived matrix, and a water-insoluble lanthanide derivative, thereby avoiding the presence of an organic solvent.

26. The composition of claim 25, wherein the water-insoluble lanthanide derivative is selected from the group consisting of cerium hydroxide/cerium oxide, cerium stearate, cerium octoate, cerium naphthenate, cerium phosphate, cerium phosphonate and cerium dodecylbenzene sulfonate.

* * * * *